US010931019B1

(12) United States Patent
Kefauver et al.

(10) Patent No.: US 10,931,019 B1
(45) Date of Patent: Feb. 23, 2021

(54) HELIX ANTENNA

(71) Applicant: Lockheed Martin Corporation, Bethesda, MD (US)

(72) Inventors: W. Neill Kefauver, Littleton, CO (US); James L. Lovejoy, Jr., Colorado Springs, CO (US); Thomas Patrick Cencich, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 286 days.

(21) Appl. No.: 15/369,793

(22) Filed: Dec. 5, 2016

Related U.S. Application Data

(60) Provisional application No. 62/267,225, filed on Dec. 14, 2015.

(51) Int. Cl.

| | |
|---|---|
| ***H01Q 11/08*** | (2006.01) |
| ***H01Q 1/48*** | (2006.01) |
| ***H01Q 1/24*** | (2006.01) |
| ***H01Q 1/36*** | (2006.01) |
| ***H01Q 1/28*** | (2006.01) |

(52) U.S. Cl.
CPC ..... *H01Q 11/08* (2013.01); *H01Q 1/243* (2013.01); *H01Q 1/288* (2013.01); *H01Q 1/36* (2013.01); *H01Q 1/48* (2013.01)

(58) Field of Classification Search
CPC ..... H01Q 11/08; H01Q 1/362; H01Q 1/36; H01Q 1/24; H01Q 9/40; H01Q 1/288; H01Q 11/083
USPC ..... 343/895, 843, 866, 896
See application file for complete search history.

(56) References Cited

U.S. PATENT DOCUMENTS

| | | | | |
|---|---|---|---|---|
| 3,573,840 | A * | 4/1971 | Gouillou | H01Q 1/38 343/895 |
| 3,858,220 | A * | 12/1974 | Arnow | H01Q 1/362 343/802 |
| 5,216,436 | A * | 6/1993 | Hall | H01Q 1/08 343/752 |
| 5,329,287 | A * | 7/1994 | Strickland | H01Q 11/08 343/752 |
| 5,592,184 | A * | 1/1997 | Cassel | H01Q 1/362 343/702 |
| 6,414,648 | B1 * | 7/2002 | Holland | H01J 37/321 |
| 2006/0164322 | A1 * | 7/2006 | Lan | H01Q 1/362 343/895 |
| 2008/0012787 | A1 * | 1/2008 | Lamoureux | H01Q 11/08 343/895 |
| 2009/0219220 | A1 * | 9/2009 | Kersten | H01Q 1/241 343/860 |
| 2010/0094273 | A1 * | 4/2010 | Rossetto | A61B 18/1815 606/33 |
| 2010/0103053 | A1 * | 4/2010 | Nikitin | H01Q 1/2216 343/702 |

(Continued)

*Primary Examiner* — Dameon E Levi
*Assistant Examiner* — Jennifer F Hu
(74) *Attorney, Agent, or Firm* — Morgan, Lewis & Bockius LLP

(57) ABSTRACT

A communications system such as a global position system (GPS) device, a spacecraft tracking device, a handheld radio, or any other communications device may include one or more helix antennas. Each helix antenna may include a conductive circular ring at a distal end of one or more helical arms. In a helical antenna with multiple arms, the arms may be shorted together at the distal end by the conductive circular ring.

21 Claims, 5 Drawing Sheets

(56) References Cited

U.S. PATENT DOCUMENTS

| | | | | |
|---|---|---|---|---|
| 2011/0001680 | A1* | 1/2011 | Leisten | H01Q 11/08<br>343/859 |
| 2012/0229358 | A1* | 9/2012 | Doneker | H01Q 1/526<br>343/848 |

* cited by examiner

HELIX ANTENNA

CROSS-REFERENCES TO RELATED APPLICATIONS

This application claims priority to and the benefit of U.S. Provisional Patent Application No. 62/267,225, filed Dec. 14, 2015, which is hereby incorporated by reference in its entirety.

STATEMENT REGARDING FEDERALLY SPONSORED RESEARCH OR DEVELOPMENT

Not applicable.

FIELD

The disclosure relates in general to antennas, and in particular to, for example, without limitation, wideband antennas such as helix antennas.

BACKGROUND

The description provided in the background section, including without limitation, any problems, features, solutions or information, should not be assumed to be prior art merely because it is mentioned in or associated with the background section. The background section may include information that describes one or more aspects of the subject technology.

Conventional helix antennas include a ground plane and a radiating arm formed from a conductive wire that extends in a circular helix shape from the ground plane. In a conventional helix antenna, the radiating arm terminates at a distal end of the wire that is separated from conductive contact with any other structures For conventional helix antennas, if a smoother pattern of radiation, particularly in azimuthal symmetry, is required, more helix arms are typically added to the helix antenna. This is especially true for difference pattern helices where there is a null at broadside and the beam peaks off axis. However, adding more helix arms can complicate the beamforming structure, which increases loss.

SUMMARY

In accordance with various aspects of the subject disclosure, a helix antenna is provided with a conductive ring at a distal end of a helical radiator element that extends between the conductive ring and a ground structure for the antenna.

A conductive ring may be coupled to the end of a single arm helix antenna or more than one arm of a helix antenna. In an implementation in which a helix antenna includes multiple helical radiator arms, the helical radiator arms may be shorted together or connected at their ends by the conductive ring. Providing a helix antenna with a conductive ring at the end of a helical radiating element can reduce or eliminate the need for a more complicated beamformer and reduce the size, weight and cost of a helix antenna.

One or more helix antennas, each with a conductive ring at the end of one or more helical radiator elements, may be included in a global positioning system (GPS) satellite. Two or more helix antennas, each with a conductive ring at the end of one or more helical radiator elements, may be included in a phased array antenna, or electronically scanned array (ESA). Helix antennas with a conductive ring may be implemented in, for example, radar and active phased arrays. Various aspects of the subject disclosure relate to an antenna, a helix, and/or helices.

In accordance with various aspects of the subject disclosure, an antenna is provided that includes a helical radiator element. The antenna also includes a ground plane structure that defines a first plane, the ground plane structure disposed at a proximal end of the helical radiator element. The antenna also includes a conductive ring conductively coupled to a distal end of the helical radiator element. The helical radiator element extends, in the form of a circular helix about an axis that is perpendicular to the first plane, between the ground plane structure and the conductive ring.

In accordance with other aspects of the subject disclosure, a communications device is provided that includes an antenna. The antenna includes a helical radiator element. The antenna also includes a ground plane structure that defines a first plane, the ground plane structure disposed at a proximal end of the helical radiator element. The antenna also includes a conductive ring conductively coupled to a distal end of the helical radiator element. The helical radiator element extends, in the form of a circular helix about an axis that is perpendicular to the first plane, between the ground plane structure and the conductive ring.

In accordance with other aspects of the subject disclosure, a spacecraft is provided that includes a spacecraft body and at least one antenna attached to the spacecraft body. The at least one antenna includes a helical radiator element. The at least one antenna also includes a ground plane structure that defines a first plane, the ground plane structure disposed at a proximal end of the helical radiator element. The at least one antenna also includes a conductive ring conductively coupled to a distal end of the helical radiator element. The helical radiator element extends, in the form of a circular helix about an axis that is perpendicular to the first plane, between the ground plane structure and the conductive ring.

It is to be understood that both the foregoing general description and the following detailed description are exemplary and explanatory and are intended to provide further explanation of the subject technology as claimed. It is also to be understood that other aspects may be utilized and changes may be made without departing from the scope of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

In accordance with various aspect of the disclosure, a helix antenna is provided that includes a conductive ring. For example, the conductive ring may be a conductive circular ring conductively coupled to a distal end of a helical radiator element. Helix antennas having a conductive ring may be implemented in any of various communications systems and/or devices.

Figure 1:
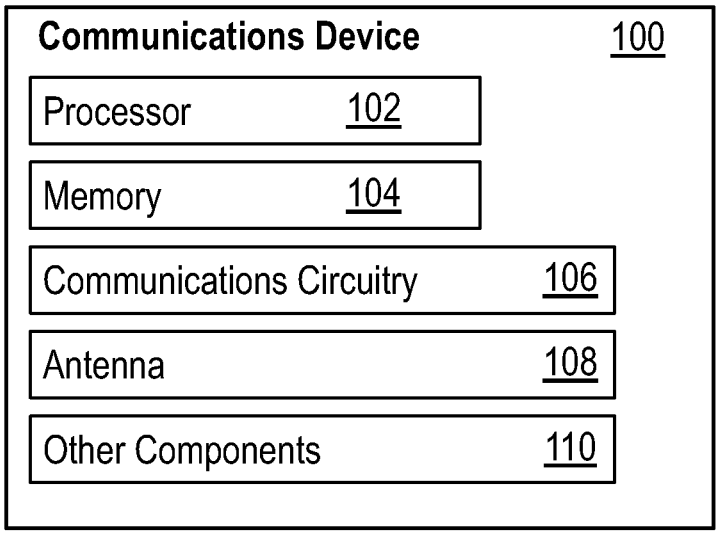
FIG. 1 illustrates a block diagram of a communications device in accordance with certain aspects of the disclosure.

FIG. 1 illustrates a block diagram of an exemplary communications device having an antenna. As shown in FIG. 1. communications device 100 includes one or more antennas such as antenna 108. Communications device 100 may include a single antenna 108 or multiple antennas 108 (e.g., an array of antennas or multiple individually controlled antennas).

Communications device 100 may be a portable device such a handheld radio device, a fixed device such as a television antenna that is mounted to a structure (e.g., a building, a communications tower, or the ground), another type of mobile device such as a vehicle-mounted communications device (e.g., a communications device disposed on a car, truck, tank, boat, ship, submarine, or aircraft), or a space-based device such as a satellite (e.g., a global positioning system (GPS) satellite or other communications satellite).

As shown in FIG. 1, communications device 100 may include other components 110. Other components 110 may be specific components for a specific device such as spacecraft components (e.g., a spacecraft body to which one or more helix antennas having conductive rings are attached, solar panels or other power sources) for a spacecraft such as a satellite, vehicle components (e.g., wheels, rudders, and/or propulsion systems) for a vehicle, handheld device components such as housing, or other suitable components as desired. Other components 110 may include user interface components such as a visual display, a speaker that generates sound responsive to signals received at antenna 108, or a microphone that generates signals to be transmitted by antenna 108 (as examples).

Communications device 100 includes communications circuitry 106 that operates antenna 108. Communications circuitry 106 includes a feedline such as a coaxial feedline that provides a current to antenna 108 during operation of antenna 108 that causes antenna 108 to radiate a desired signal. Communications circuitry 106 such as a feedline may also be arranged to receive a current generated by antenna 108 responsive to an incoming signal. Communications circuitry 106 may also include signal processing circuitry such as one or more amplifiers, filters, analog-to-digital (ADC) converters that convert analog signals from antenna 108 to digital signals for further processing and/or transmission, digital-to-analog converters (DACs) that convert digital signals to analog signals for transmission by antenna 108, oscillators, mixers, or the like as would be understood by one skilled in the art.

Communications circuitry 106 may be coupled to external broadcasting or receiving systems and/or to internal computing circuitry such as processor 102 and/or memory 104. In some configurations, processor 102 may cause communications circuitry 106 to provide a desired feedline signal to antenna 108 to cause antenna 108 to radiate a desired signal. In some configurations, processor 102 may receive a signal from antenna 108 via communications circuitry 106 and further process signals received from antenna 108 (e.g., to encode or decode the received signals, to generate image data or audio data from the received signals, or to determine a location of a transmitting device relative to communications device 100). Processor 102 may interact with memory 104 to store information determined from signals received at antenna 108 or to generate signals to be transmitted by antenna 108.

For example, memory 104 may store data generated based on signals received at antenna 108, data to be transmitted by antenna 108, and/or instructions that, when executed by processor 102 cause processor 102 to operate communications circuitry 106 and antenna 108 and/or process data received from communications circuitry 106 and antenna 108.

Processor 102 may include one or more microprocessors, multi-core processors, and/or one or more integrated circuits, such as application specific integrated circuits (ASICs) or field programmable gate arrays (FPGAs) that load and execute sequences of instructions, software modules, etc. Processor 102 may execute instructions stored in memory 104. In some implementations, such integrated circuits execute instructions that are stored on the circuit itself.

Memory 104 may include computer-readable media such as RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra-density optical discs, any other optical or magnetic media, and floppy disks. Memory 104 can store sets of instructions/code that are executable by processor 102 including sets of instructions/code that implement the quantum compiler processes described herein. Examples of computer programs or computer code include machine code, such as is produced by a compiler, and files including higher-level code that are executed by a computer, an electronic component, or a microprocessor using an interpreter.

Figure 2:
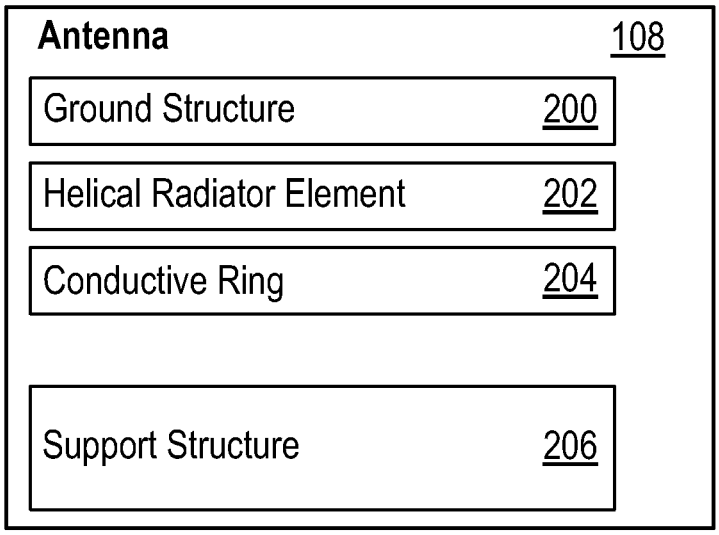
FIG. 2 illustrates a block diagram of an antenna in accordance with certain aspects of the disclosure.

FIG. 2 illustrates a block diagram of antenna 108. As shown in FIG. 2, antenna 108 includes ground structure 200, helical radiator element 202, and conductive ring 204, sometimes referred to herein as a termination ring. Ground structure 200 may be a ground plane structure such as a ground plane reflector from which the helical radiator element 202 extends in a helical shape such as a circular helix. Although helical radiator element 202 extends from ground structure 200, helical radiator element 202 is electrically insulated from ground structure 200. As shown in FIG. 2, antenna 108 may also include one or more support structures such as support structure 206. Support structure 206 may, for example, be a rigid structure, formed from an insulating material (e.g., plastic or fiberglass), that supports the helical shape of helical radiator element 202. For example, support structure 206 may be an elongate insulating structure that extends from ground structure 200 along an axis of the helix of element 202 and includes one or more transverse members (e.g., integral or separate transverse members) that mechanically attach to helical radiator element 202 at various distances from ground structure 200 to support helical radiator element 202. However, this is merely illustrative and other arrangements of support structure 206 for supporting helical radiator element 202 may be used as would be understood by one skilled in the art.

Figure 3:
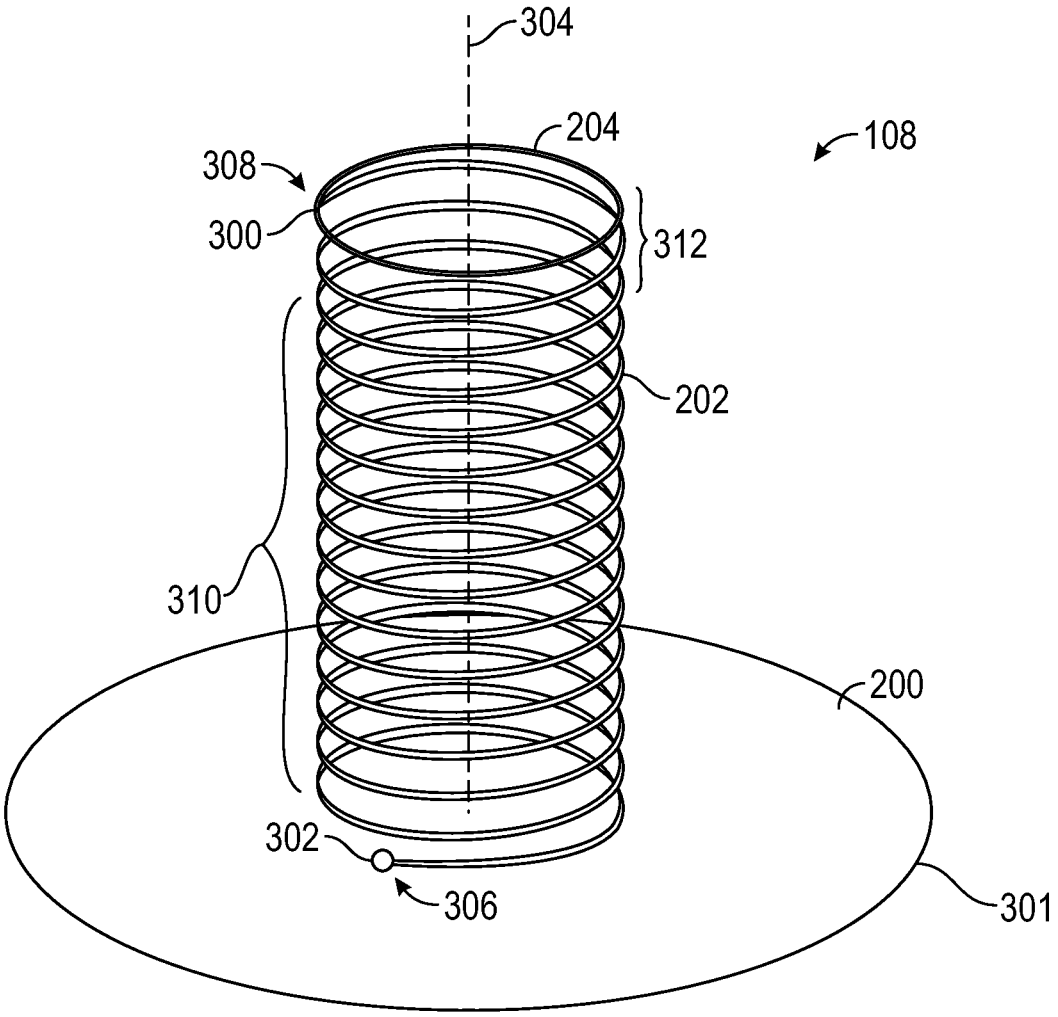
FIG. 3 illustrates a perspective view of an antenna in accordance with certain aspects of the disclosure.

Helical radiator element 202 is formed from an elongated conductor such as a wire (e.g., a copper wire or wire formed from another suitable conductor) that is wound about a linear helix axis to form a helical shape. FIG. 3 shows a perspective view of an implementation of antenna 108.

In the implementation shown in FIG. 3, ground structure 200 is implemented as a planar conductive reflector having a circular outer border 301. Helical radiator element 202 extends from ground structure 200 in the form of a circular helix shape around helix axis 304. Helical radiator element 202 has at a proximal end located at or near a ground plane structure such as ground structure 200 and extends away from the ground plane structure in the form of a circular helix about an axis 304 that is perpendicular to a first plane defined by the ground plane structure. Antenna 108 also includes a conductive ring 204 coupled to helical radiator element 202 at a distal end 308 of the helical radiator element. Helix axis 304 extends orthogonally from ground structure 200. A proximal end 306 of helical radiator element 202 may be located at or near the plane defined by ground structure 200 such that ground structure 200 is disposed at the proximal end of helical radiator element 202.

Helical radiator element 202 may be coupled to, or may be a continuous extension of a central conductor of a coaxial feed line in some implementations. At or near interface 302, proximal end 306 of helical radiator element 202 may couple to the central conductor of the coaxial feed line or may form a bend or curve in the central conductor at which the helical shape of element 202 begins. Interface 302 may include an insulating element that electrically isolates helical radiator element 202 from ground structure 200. An outer ground conductor of a coaxial feed line or another grounding structure may be conductively coupled to ground plane reflector 200.

Between proximal end 306 and distal end 308, helical radiator element 202 may form one or more windings of a helix around axis 304. Distal end 308 is conductively and mechanically coupled to conductive ring 204 at a coupling 300. Distal end 308 of helical radiator element 202 may be located at the end of a complete winding or a partial winding of helical radiator element 202.

Conductive ring 204 may be formed from a contiguous extension of helical radiator element 202 that extends around axis 304 and recouples to a previous winding of helical radiator element or conductive ring 204 may be a separate conductive ring that is attached (e.g., soldered, welded, or coupled using a conductive coupling element such as a clip) to helical radiator element 202 at coupling 300. Conductive ring 204 may be a circular conductive ring. The circular conductive ring may have a radius that is equal to or different from the radius of the helix of helical radiator element 202. The radius of the circular conductive ring and the radius of the helix of helical radiator element 202 are smaller than the radius of circular ground plane structure 200.

Conductive ring 204 may be formed, for example, from an elongated conductive structure such as a wire. The elongated conductive structure is curved, within a plane, such that opposing ends of the elongated conductive structure meet to form the complete ring. The curve of the elongated conductive structure may be a circular curve, an elliptical curve, a rectilinear curve or another suitable curve within the plane. In some implementations, some portions of the elongated conductive structure may be curved out of, and back into, the plane defined by the ring.

The elongated conductive structure may have a cross-sectional width (e.g., a cross-sectional diameter for a circular wire) that is substantially smaller than the width of the ring itself (e.g., the diameter of a circular conductive ring). The interior of conductive ring 204 (e.g., the space between opposing sides of the ring) may be an air gap or may be filled with a dielectric material (e.g., a dielectric plate).

Conductive ring 204 may be mechanically supported by the coupling to helical radiator element 202 (e.g., without any contact with other conductive or insulating structures such as support structures). However, this is merely illustrative. In other implementations, conductive ring 204 may be supported, in part, by a portion of support structure 206 (e.g., by connection to a transverse extension from an axial insulating support structure for helical radiator element 202).

Ground structure 200 may define a first plane from which radiator 202 extends. Helical radiator element 202 may extend from the first plane to a second plane defined by conductive ring 204. Conductive ring 204, whether circular or otherwise shaped (e.g., in an elliptical ring, a square ring, a rectangular ring, etc.) may be arranged such that the second plane defined by conductive ring 204 is parallel to the first plane defined by ground structure 200 or such that the second plane defined by conductive ring 204 is formed at a non-parallel angle to the first plane defined by ground structure 200.

In some implementations, the windings of helical radiator element 202 are all equally spaced and located at a constant radius from axis 304. In other implementations, helical radiator element 202 has a first set of windings 310 that are equally spaced and having a constant radius from axis 304 and a second set 312 of windings that are tapered to reduce cross-polarization.

Figure 4:
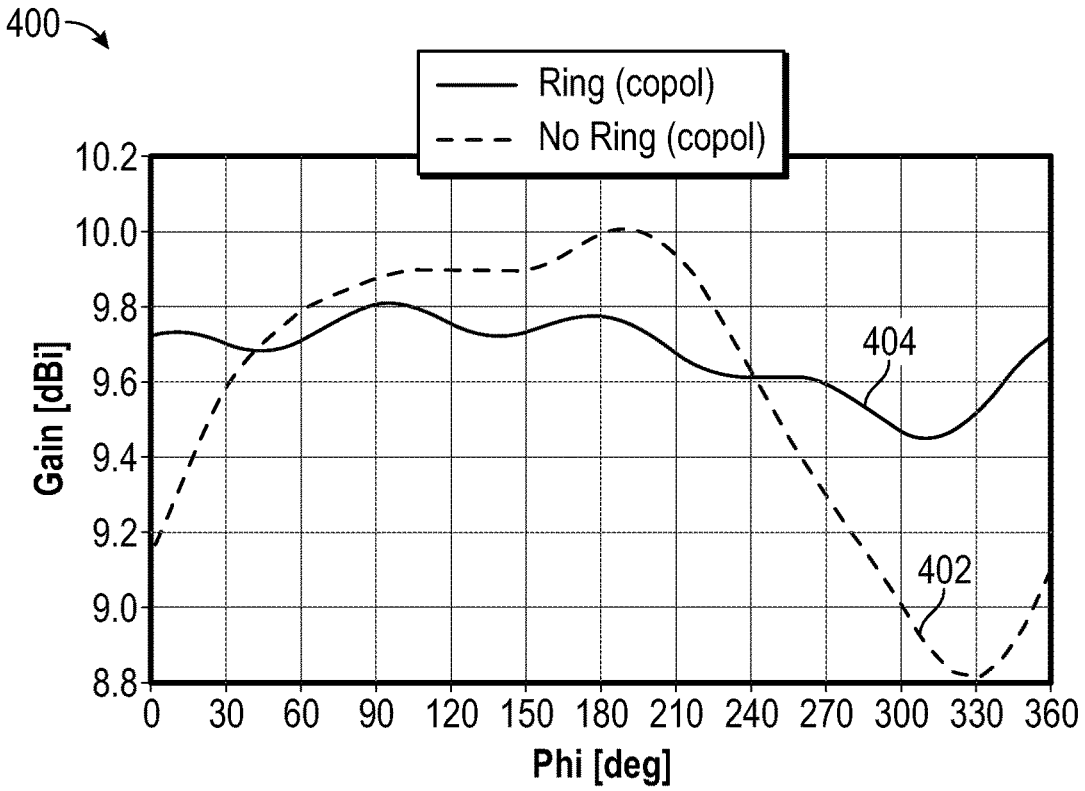
FIG. 4 illustrates a graph showing antenna gains as a function of azimuth angle for antennas with and without a termination ring in accordance with certain aspects of the disclosure.
Figure 5:
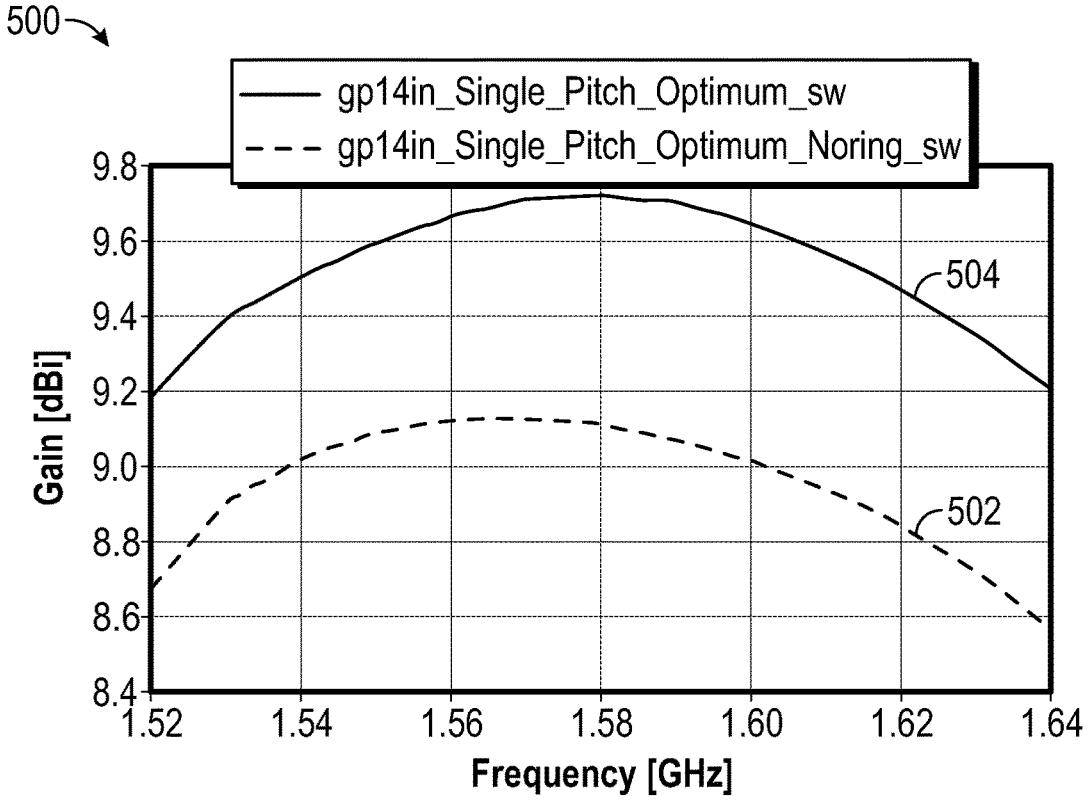
FIG. 5 illustrates a graph showing antenna gains as a function of frequency for helix antennas with and without a termination ring in accordance with certain aspects of the disclosure.
Figure 6:
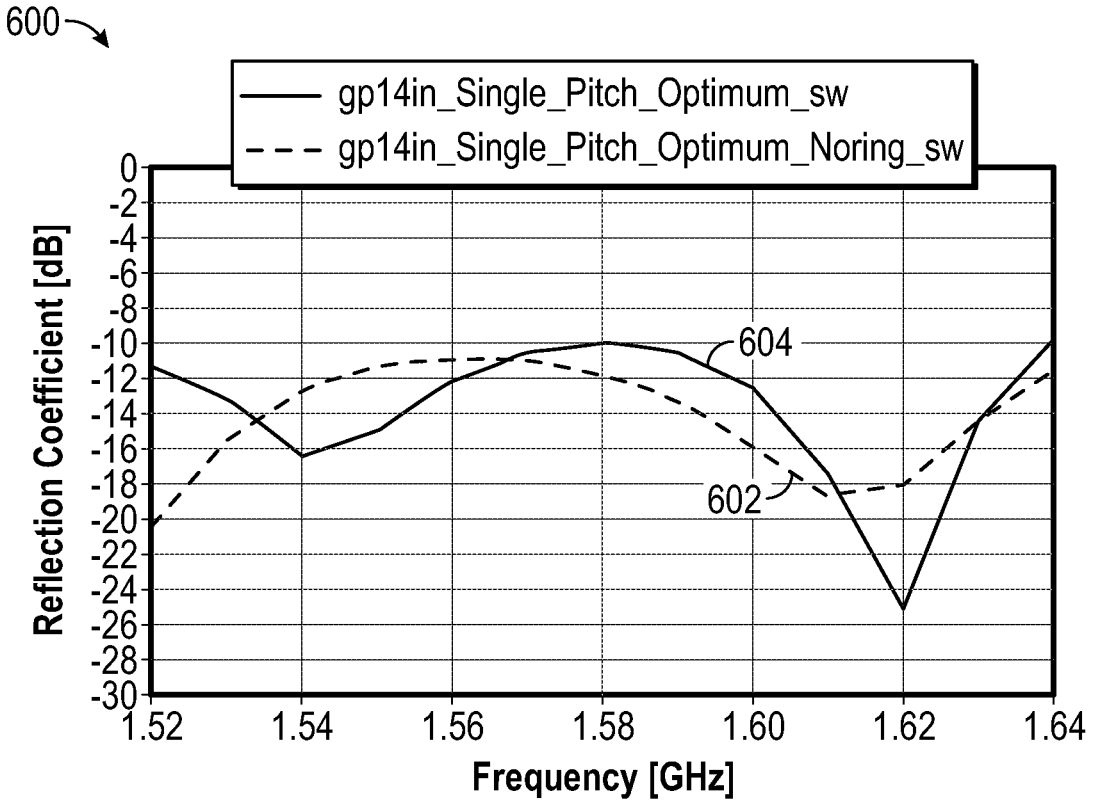
FIG. 6 illustrates a graph showing antenna reflection coefficients as a function of frequency for helix antennas with and without a termination ring in accordance with certain aspects of the disclosure.

It has been discovered that providing a conductive ring at the distal end of a helix antenna can reduce or eliminate the need for a more complicated beamformer and reduce size, weight and cost for the antenna. Various advantages and features of a helix antenna with a conductive ring at the distal end are illustrated in FIGS. 4, 5, and 6, FIG. 4 shows a graph 400 of antenna gain, Gain, in decibels-isotropic (dBi) as a function of azimuth angle, Phi, in degrees (deg) for helix antennas with and without a conductive ring at the distal end. In particular, graph 400 includes a first curve 402 showing the gain for a conventional helix antenna without a conductive ring and second curve 404 showing the gain for a helix antenna having a conductive ring (e.g., helix antenna 108). As shown in FIG. 4, the gain for the conventional helix antenna has steep falloffs at small (e.g., less than 40 degrees) and large (e.g., greater than 240 degrees) azimuthal angles that are not present in the gain for the helix antenna with a conductive ring. Accordingly, the helix antenna having the conductive ring has an azimuthal symmetry that is improved with respect to the conventional helix antenna.

FIG. 5 shows a graph 500 of antenna gain in decibels (dB) as a function of frequency in gigahertz (GEL) for helix antennas with and without a conductive ring at the distal end. In particular, graph 500 includes a first curve 502 showing the gain for a conventional helix antenna without a conductive ring and second curve 504 showing the gain for a helix antenna having a conductive ring (e.g., helix antenna 108). Curves 502 and 504 may be considered to represent gains at an azimuth angle of zero and an altitude (theta) of 22 deg above the ground plane. As shown in FIG. 5, the gain for the conventional helix antenna is lower at all displayed frequencies than the gain for the helix antenna with a conductive ring. Accordingly, the helix antenna having the conductive ring has gain distribution that is improved with respect to the conventional helix antenna.

FIG. 6 shows a graph 600 of antenna reflection coefficient in decibels (dB) as a function of frequency in GHz for helix antennas with and without a conductive ring at the distal end. In particular, graph 600 includes a first curve 602 showing the reflection coefficient for a conventional helix antenna without a conductive ring and second curve 604 showing the reflection coefficient for a helix antenna having a conductive ring (e.g., helix antenna 108). As shown in FIG. 6, the bandwidths for the helix antenna having the conductive ring and the conventional helix antenna are similar such that loss of bandwidth is an unexpectedly minor issue for helix antennas having conductive rings.

Figure 7:
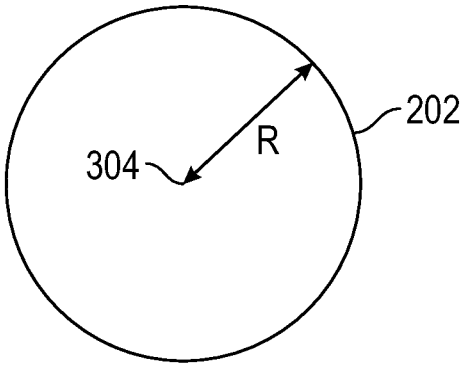
FIG. 7 illustrates a top view of a helical radiator element for a helix antenna in accordance with certain aspects of the disclosure.
Figure 8:
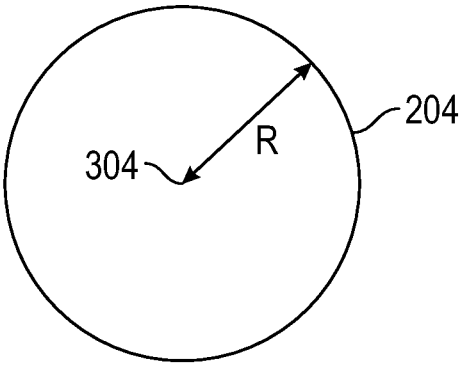
FIG. 8 illustrates a top view of a termination ring for a helix antenna in accordance with certain aspects of the disclosure.

FIGS. 7 and 8 show top views, respectively of helical radiator element 202 and conductive ring 204 in an implementation in which helical radiator element 202 and conductive ring 204 having a common radius R with respect to central axis 304. Helical radiator element 202 and conductive ring 204 may be formed from a common material or different materials and may have a cross-sectional size and/or shape that are the same or different. For example, helical radiator element 202 and conductive ring 204 may have a common circular diameter, in cross section, in some implementations.

In implementations in which antenna 108 is implemented on a spacecraft such as a GPS spacecraft, radius R of the helix and the circular ring may be between, for example, 4 inches and 5 inches, or between 4.4 inches and 4.8 inches. In implementations in which antenna 108 is implemented on a spacecraft such as a GPS spacecraft, ground structure 200 may be a circular ground plane having a radius of, for example, between 10 inches and 18 inches, or between 13 inches and 15 inches. In implementations in which antenna 108 is implemented on a spacecraft such as a GPS spacecraft, helical radiator element 202 may have, for example, between 26 and 29 turns (e.g., 27.5 turns) and be formed in the shape of a circular helix with an alpha angle of between 1.4 and 1.5 degrees such that the helical radiator element extends between, for example, 9 inches and 11 inches from the ground plane structure. In implementations in which antenna 108 is implemented on a spacecraft such as a GPS spacecraft, helical radiator element 202 may have a set 312 of three tapered windings. However, it should be appreciated that the dimensions discussed herein are exemplary and larger or smaller helix antennas with conductive rings can be provided for various implementations and applications as desired. As examples, helical radiator element 202 may be sized and arranged to transmit and/or receive signals in one or more International Telecommunication Union (ITU) radio bands such as the ITU VHF, UHF, SHF, EHF, and/or THF bands, one or more Institute of Electrical and Electronics Engineers (IEEE) radio bands such as the IEEE VHF, UHF, L, S, C, X, Ku, K, Ka, V, W, and/or mm bands and/or other radio or microwave signals such as 1.56-1.58 GHz signals.

Figure 9:
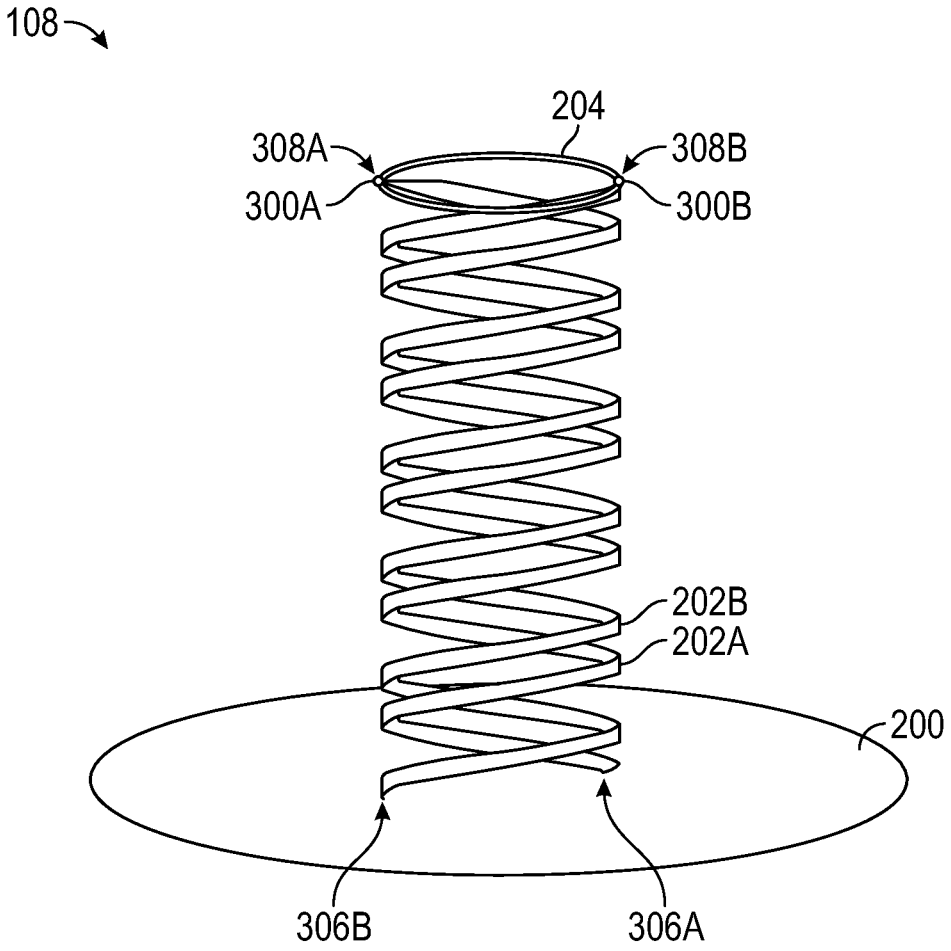
FIG. 9 illustrates a perspective view of a helix antenna having multiple helical radiator elements and a termination ring in accordance with certain aspects of the disclosure.

Various examples have been described in connection with FIGS. 1-8 in which antenna 108 includes a single helical radiator element. However, in some implementations, antenna 108 may include multiple helical radiator elements that extend between a common ground structure and a common conductive ring. FIG. 9 shows an exemplary implementation in which antenna 108 includes two helical radiator elements 202A and 202B that each extend between a common circular ground plane structure 200 and a common conductive ring 204.

In the example of FIG. 9, helical radiator elements 202A and 202B both have a circular helix shape with a radius that is the same as the radius of conductive ring 204. Helical radiator elements 202A and 202B have respective proximal ends 306A and 306B at or near circular ground plane structure 200 (and electrically isolated therefrom) and respective distal ends 308A and 308B that conductively couple to conductive ring 204 at respective couplings 300A and 300B such that helical radiator elements 202A and 202B are shorted together by conductive ring 204. In the example of FIG. 9, couplings 300A and 300B are located at different positions around the circumference of the circular conductive ring. However, in other implementations, couplings 300A and 300B may be at a common location on conductive ring 204. Table 1 below shows gain changes (A Gain) and azimuthal variance (Az Var) in dB for four configurations of a helix antenna including a "1 wire, no loop" configuration with a single helical radiator element and no conductive ring, a "2 wires, no loop" configuration with two helical radiator elements and no conductive ring, a "1 wire, w loop" configuration with a single helical radiator element 202 and a conductive ring 204, and a "2 wire, w loop" configuration with two helical radiator elements 202A and 202B and a conductive ring 204.

TABLE 1

| Config | Δ Gain (dB) | Az Var (dB) |
|---|---|---|
| 1 wire, no loop | 0 | 1.2 |
| 2 wires, no loop | 0.8 | 0.2 |
| 1 wire, w loop | 0.9 | 0.15 |
| 2 wires, w loop | 1 | 0.15 |

Table 1 shows that even a helix antenna with a single helical radiator element and a conductive ring (e.g., as in the example of FIG. 3) has improved gain and azimuthal variance even with respect to a helix antenna with two helical radiator elements and no conductive ring, and can be implemented without the additional feeding complications associated with multiple radiator elements. Adding a second helical radiator element (e.g., as in the configuration of FIG. 9) provides still further improvement.

Figure 10:
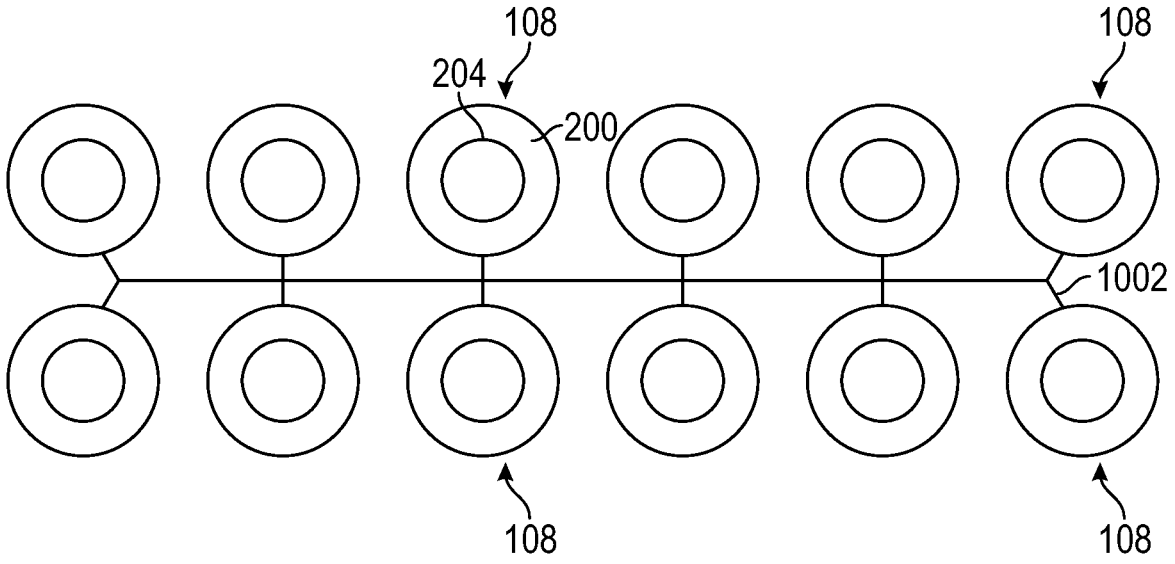
FIG. 10 illustrates a top view of an array of helix antennas, each having a termination ring in accordance with certain aspects of the disclosure.

FIG. 10 shows a top view of an exemplary array of antennas 108, each having a ground plane reflector 200, a conductive ring 204, and one or more helical radiator elements 202 (not visible in FIG. 10' that extend between an insulating interface with the ground plane reflector 200 and the conductive ring. In the example of FIG. 10, antennas 108 are mounted in an array 1000 using a common support structure 1002. Antennas 108 of array 1000 may be arranged and operated as a phased array antenna, or electronically scanned antenna (ESA) as would be understood by one skilled in the art.

In the example of FIG. 10, array 1000 includes twelve antennas 108 arranged in two rows and six columns. However, this is merely illustrative. In various communications devices, an array of antennas 108, each having a ground plane reflector 200, a conductive ring 204, and a helical radiator element 202 that extends between the ground plane reflector 200 and the conductive ring 204 (e.g., as described herein in connection with FIGS. 1-9) can include two, three, four, more than four, ten, more than ten, or hundreds or more antennas 108. In other communications devices, only a single antenna having a ground plane reflector 200, a conductive ring 204, and a helical radiator element 202 that extends between the ground plane reflector 200 and the conductive ring 204 may be provided.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these aspects will be readily apparent to those skilled in the art, and generic principles defined herein may be applied to other aspects. Thus, many changes and modifications may be made to the subject technology, by one having ordinary skill in the art, without departing from the scope of the subject technology.

It is understood that the specific order or hierarchy of steps in the processes disclosed is an illustration of exemplifying approaches. Based upon design preferences, it is understood that the specific order or hierarchy of steps in the processes may be rearranged. Some of the steps may be performed simultaneously.

It is noted that dimensional aspects (e.g., spacecraft height, antenna diameter, core cylinder structure diameter) provided above are examples and that other values for the dimensions can be utilized in accordance with one or more implementations. Furthermore, the dimensional aspects provided above are generally nominal values. As would be appreciated by a person skilled in the art, each dimensional aspect, such as radius, has a tolerance associated with the dimensional aspect.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, 13, or C" each refer to only A, only B, or only C; any combination of A, B, and C; and/or at least one of each of A, B, and C.

A reference to an element in the singular is not intended to mean "one and only one" unless specifically stated, but rather "one or more". The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for". Furthermore, to the extent that the term "include", "have", or the like is used in the description or the claims, such term is intended to be inclusive in a manner similar to the term "comprise" as "comprise" is interpreted when employed as a transitional word in a claim.

What is claimed is:

1. An antenna, comprising:

a helical radiator element formed of an elongated conductive wire;

a ground plane structure that defines a first plane, the ground plane structure disposed at a proximal end of the helical radiator element; and a conductive ring formed at a distal end of the elongated conductive wire of the helical radiator element at a coupling, wherein the helical radiator element extends, in the form of a circular helix about an axis that is perpendicular to the first plane, between the ground plane structure and the conductive ring, wherein the conductive ring is a contiguous extension of the elongated conductive wire of the helical radiator element and recouples to a previous winding of the helical radiator element, and wherein the conductive ring comprises a dielectric material between opposing sides of the conductive ring forming a dielectric plate in a plane of the conductive ring.

2. The antenna of claim 1, wherein the conductive ring defines a second plane that is parallel to the first plane.

3. The antenna of claim 1, wherein the conductive ring is a circular conductive ring.

4. The antenna of claim 3, wherein the circular conductive ring has a radius that is equal to a radius of the circular helix.

5. The antenna of claim 1, wherein the ground plane structure has a circular outer border.

6. The antenna of claim 1, further comprising a support structure for the helical radiator element, wherein the conductive ring comprises an elongated conductive structure that is curved within a plane to form a complete ring.

7. The antenna of claim 1, further comprising an additional helical radiator element that extends between the ground plane structure and the conductive ring.

8. The antenna of claim 7, wherein the additional helical radiator element has a proximal end at the ground plane structure, extends away from the ground plane structure in the form of a circular helix about the axis, and has a distal end conductively coupled to conductive ring.

9. The antenna of claim 8, wherein the distal end of the helical radiator element is coupled to the conductive ring at a first location and the distal end of the additional helical radiator element is coupled to the conductive ring at a second location that is different from the first location.

10. The antenna of claim 1, further comprising an interface at the proximal end of the helical radiator element that comprises an insulating element that electrically isolates the helical radiator element from the ground plane structure.

11. A communications device, comprising:

an antenna, comprising:

a helical radiator element formed of an elongated conductive wire;

a ground plane structure that defines a first plane, the ground plane structure disposed at a proximal end of the helical radiator element; and a conductive ring formed at a distal end of the elongated conductive wire of the helical radiator element at a coupling, wherein the helical radiator element extends, in the form of a circular helix about an axis that is perpendicular to the first plane, between the ground plane structure and the conductive ring, and wherein the conductive ring comprises a dielectric material between opposing sides of the conductive ring forming a dielectric plate in a plane of the conductive ring.

12. The communications device of claim 11, further comprising a coaxial feed line having a first conductor coupled to the helical radiator element and a second conductor coupled to the ground plane structure.

13. The communications device of claim 12, further comprising communications circuitry coupled to the antenna and configured to process signals for transmission by the antenna and signals received by the antenna.

14. The communications device of claim 11, further comprising a plurality of additional antennas arranged in an array, wherein each of the plurality of additional antennas comprise:

a ground plane structure that defines a first plane;

a helical radiator element having a proximal end at the ground plane structure and extending away from the ground plane structure in the form of a circular helix about an axis that is perpendicular to the first plane; and a conductive ring coupled to the helical radiator element at a distal end of the helical radiator element.

15. The communications device of claim 14, further comprising communications circuitry configured to operate the array as an electronically scanned array.

16. The communications device of claim 11, wherein the communications device comprises a handheld radio.

17. The antenna of claim 11, wherein the conductive ring defines a second plane that is parallel to the first plane, wherein conductive ring is a circular conductive ring, and wherein the circular conductive ring has a radius that is equal to a radius of the circular helix.

18. A spacecraft, comprising:

a spacecraft body; and at least one antenna attached to the spacecraft body, the at least one antenna comprising:

a helical radiator element formed of an elongated conductive wire;

a ground plane structure that defines a first plane, the ground plane structure disposed at a proximal end of the helical radiator element; and a conductive ring formed at a distal end of the elongated conductive wire of the helical radiator element at a coupling, wherein the helical radiator element extends, in the form of a circular helix about an axis that is perpendicular to the first plane, between the ground plane structure and the conductive ring, and wherein the conductive ring comprises a dielectric material between opposing sides of the conductive ring forming a dielectric plate in a plane of the conductive ring.

19. The spacecraft of claim 18, wherein the conductive ring defines a second plane that is parallel to the first plane, and wherein conductive ring is a circular conductive ring.

20. The spacecraft of claim 19, wherein the circular conductive ring has a radius that is equal to a radius of the circular helix.

21. The spacecraft of claim 18, wherein the spacecraft comprises a global positioning system satellite.

* * * * *